US011819900B2

(12) United States Patent
Uchiyama et al.

(10) Patent No.: US 11,819,900 B2
(45) Date of Patent: Nov. 21, 2023

(54) SEQUENTIAL MOLDING TOOL

(71) Applicant: NISSAN MOTOR CO., LTD., Yokohama (JP)

(72) Inventors: Noriko Uchiyama, Kanagawa (JP); Hirotaka Miwa, Kanagawa (JP); Hidenori Watanabe, Kanagawa (JP); Toshikazu Nanbu, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 0 days.

(21) Appl. No.: 17/924,773

(22) PCT Filed: May 14, 2020

(86) PCT No.: PCT/IB2020/000524
§ 371 (c)(1),
(2) Date: Nov. 11, 2022

(87) PCT Pub. No.: WO2021/229254
PCT Pub. Date: Nov. 18, 2021

(65) Prior Publication Data

US 2023/0191471 A1 Jun. 22, 2023

(51) Int. Cl.
*B21D 31/00* (2006.01)
*B21D 37/01* (2006.01)
(Continued)

(52) U.S. Cl.
CPC ..... *B21D 31/005* (2013.01)

(58) Field of Classification Search
CPC ..... B21D 31/005; B21D 31/06; B21D 22/18; B21D 37/01
(Continued)

(56) References Cited

U.S. PATENT DOCUMENTS

2014/0283571 A1* 9/2014 Ren ..... B21D 31/00 72/115
2015/0192195 A1 7/2015 Okamoto et al.
(Continued)

FOREIGN PATENT DOCUMENTS

CN 104903631 A 9/2015
JP 2014-095392 A 5/2014
(Continued)

OTHER PUBLICATIONS

English translate (JP2017051995A), retrieved date Apr. 2, 2023.*

*Primary Examiner* — Matthew Katcoff
*Assistant Examiner* — Mohammed S. Alawadi
(74) *Attorney, Agent, or Firm* — Foley & Lardner LLP

(57) ABSTRACT

An incremental forming tool of the present invention includes a holding portion attached to an incremental forming apparatus and a free curved surface part for pressing a metal plate.
The free curved surface part is made of at least a hard metal base material and a surface of the free curved surface part is covered with a hard film.
The surface of the hard film has an Rpk of 0.15 μm or less, the Rpk is defined by JIS B 0671 and is calculated from a material ratio curve of a roughness curve, and has an Ra of 0.2 μm or less, the Ra is defined by JIS B 0601 and is calculated from a roughness curve. Therefore, a molded product having a smooth worked surface with no roughness can be produced without adding any extra equipment for preventing adhesion.

7 Claims, 7 Drawing Sheets

(51) Int. Cl.
*C23C 16/00* (2006.01)
*C23C 16/27* (2006.01)

(58) Field of Classification Search
USPC ..... 72/462; 76/107.1; 73/1.89, 81, 82
See application file for complete search history.

(56) References Cited

U.S. PATENT DOCUMENTS

| | | | | |
|---|---|---|---|---|
| 2016/0003356 | A1 | 1/2016 | Ozaki et al. | |
| 2018/0264538 | A1* | 9/2018 | Roth | B21D 31/005 |
| 2022/0118501 | A1* | 4/2022 | Ren | G06F 30/23 |

FOREIGN PATENT DOCUMENTS

| | | | | |
|---|---|---|---|---|
| JP | 2017-051995 | A | | 3/2017 |
| JP | 2017051995 | A | * | 3/2017 |
| JP | 2017-217657 | A | | 12/2017 |
| JP | 2018-015805 | A | | 2/2018 |
| JP | 2018-192487 | A | | 12/2018 |
| JP | 6493111 | B2 | | 4/2019 |

* cited by examiner

SEQUENTIAL MOLDING TOOL

TECHNICAL FIELD

The present invention relates to an incremental forming tool, and in more detail, relates to a rod-shaped incremental forming tool that is usable as a fixed pressing tool and/or a movable pressing tool of an incremental forming apparatus.

BACKGROUND ART

A plastic processing method for mass production of automobile parts, etc., employs a widely used press working that uses dies.

Unfortunately, a plastic processing method that uses a pressing apparatus and dies requires a large-size facility and preparing dies for each part, resulting in causing a lot of expenses. Thus, this method is not suitable for production of a wide variety of products in small quantities in accordance with diversified needs of consumers. In addition, there is a limitation in shape of a part that can be manufactured by press working, and it is difficult to manufacture a formed object having a complicated shape.

An incremental forming method is known as a forming method that enables manufacturing a formed object having a complicated shape, without the need for dies. The incremental forming method is a forming method for forming a metal plate into a predetermined three-dimensional shape as follows: a rod-shaped incremental forming tool is pressed against a metal plate having a circumferential part that is fixed by a support frame, and in this state, the incremental forming tool is relatively moved to extend the metal plate.

Such an incremental forming method is generally performed by supplying a lubricating oil to a worked surface, in order to prevent a metal plate and an incremental forming tool from adhering together.

Patent Document 1 discloses a technique for obtaining a smooth formed object without roughening a worked surface. This technique involves incrementally forming a metal plate while locally melting the surface thereof, whereby the metal plate and the incremental forming tool are prevented from adhering together without supplying a lubricating oil to the worked surface.

CITATION LIST

Patent Document

Patent Document 1: JP 2017-051995A

SUMMARY OF INVENTION

Technical Problem

However, the incremental forming method of Patent Document 1 requires a large amount of energy in forming a metal plate that has a high melting point. In addition, a facility for heating a metal plate is necessary, which causes an increase in size of an incremental forming apparatus.

The present invention has been made in view of such problems in existing techniques, and an object of the present invention is to provide an incremental forming tool that enables obtaining a formed object having a smooth worked surface, without additionally installing a facility for preventing a metal plate and the incremental forming tool from adhering together.

Solution to Problem

The inventors of the present invention have conducted an intensive study in order to achieve the above object, and they have found that providing a hard film that contains crystalline carbon (which may hereinafter be called a "hard film"), at a part for pressing a metal plate of an incremental forming tool, and controlling surface roughness of the hard film to be within a predetermined range, enables achieving the above object. Thus, the present invention has been completed.

That is, an incremental forming tool of the present invention includes a holding part and a free curved surface part. The holding part is configured to be attached to an incremental forming apparatus. The free curved surface part is configured to press a metal plate.

The free curved surface part is made of at least a hard metal base material and has a hard film that contains crystalline carbon, on a surface thereof.

A surface of the hard film has an Rpk (average reduced peak height) of 0.15 μm or less, which is calculated from a material ratio curve of a roughness curve specified in JIS B 0671, and it also has an Ra (arithmetic average roughness) of 0.2 μm or less, which is calculated from a roughness curve specified in JIS B 0601.

Advantageous Effects of Invention

In the present invention, a hard film that contains crystalline carbon is formed on a free curved surface part for pressing a metal plate, and surface roughness of the hard film is controlled to be within a predetermined range. Thus, it is possible to provide an incremental forming tool that enables obtaining a formed object having a smooth worked surface, without additionally installing a facility for preventing adhesion.

DESCRIPTION OF EMBODIMENTS

An incremental forming tool of the present invention will be described in detail.

Figure 1:
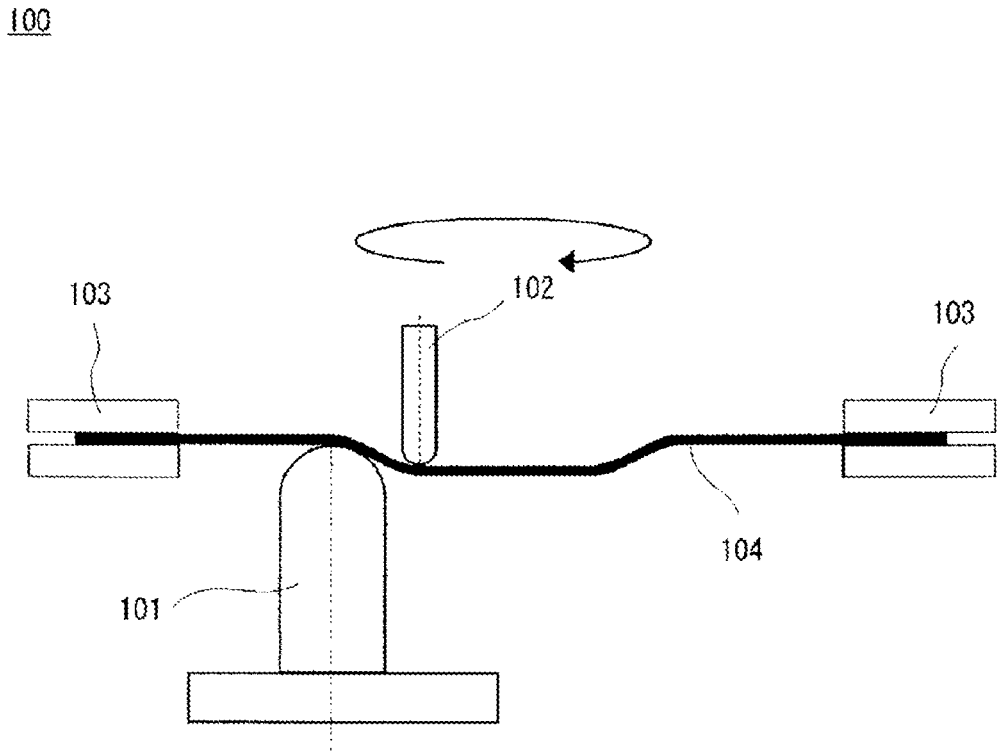
FIG. 1 is a schematic diagram of an incremental forming apparatus.
Figure 2:
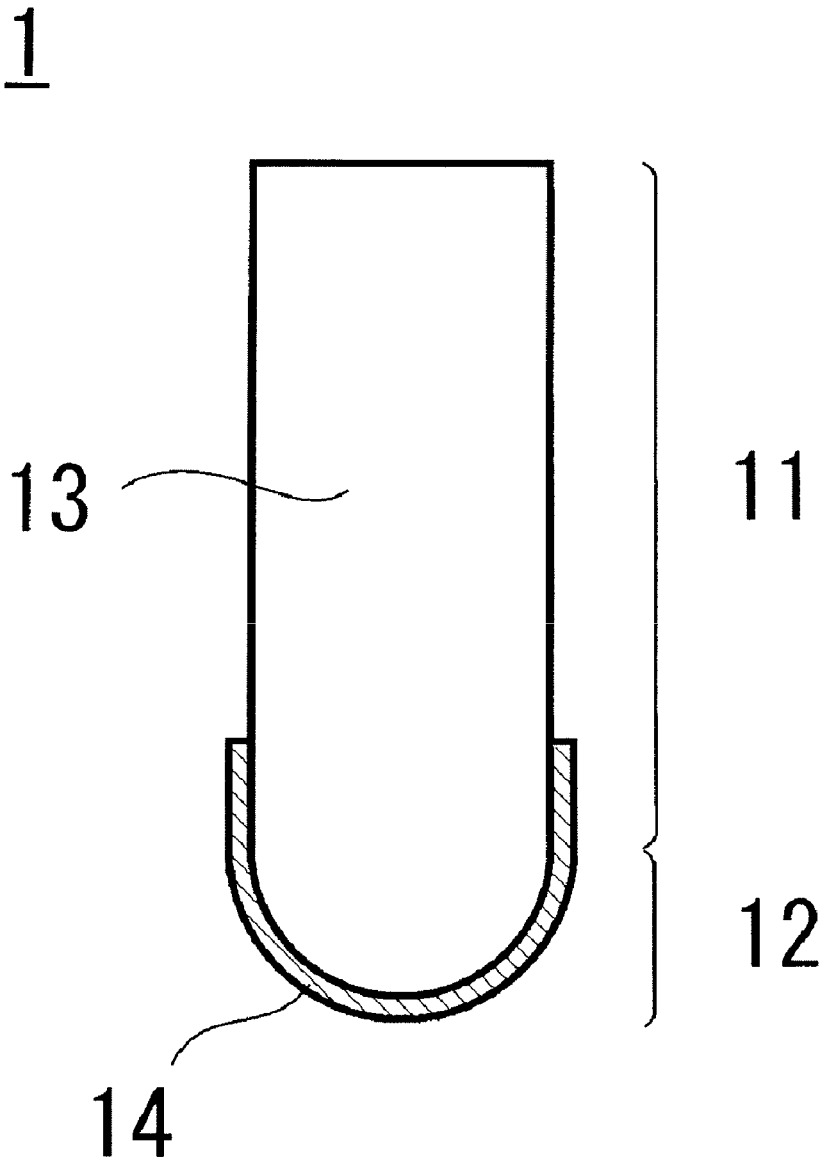
FIG. 2 is a schematic diagram of an incremental forming tool.

The incremental forming tool is a rod-shaped tool that is usable as a fixed pressing tool 101 and/or a movable pressing tool 102 of an incremental forming apparatus 100 illustrated in FIG. 1. As illustrated in FIG. 2, the incremental forming tool includes a holding part 11 and a free curved surface part 12. The holding part 11 is configured to be attached to the incremental forming apparatus 100. The free curved surface part 12 is configured to press a metal plate. The free curved surface part 12 is made of at least a hard metal base material 13 and has a hard film 14 that contains crystalline carbon, on a surface thereof.

The incremental forming tool of the present invention, which has a free curved surface part that is formed of combination of multiple linear shapes, is different from a cutting tool and so on that are formed of a simple linear shape, such a straight line or a spiral, and it has a large area to be in contact with a metal plate and tends to be applied with a very large load.

In consideration of this, the surface shape of the free curved surface part to be in contact with a metal plate, which is a workpiece, greatly affects not only the surface quality of the metal plate but also the product life (load-bearing capacity) of the incremental forming tool itself. Thus, the surface shape of the free curved surface part is particularly important for the incremental forming tool.

(Hard Film Containing Crystalline Carbon)

The surface of the hard film has an Rpk (average reduced peak height) of 0.15 μm or less and has an Ra (arithmetic average roughness) of 0.2 μm or less. The value of Rpk is calculated from a material ratio curve of a roughness curve specified in JIS B 0671 and may hereinafter be called an "Rpk (average reduced peak height)". The value of Ra is calculated from a roughness curve specified in JIS B 0601 and may hereinafter be called an "Ra (arithmetic average roughness)". The values of Rpk (average reduced peak height) and Ra (arithmetic average roughness) are, respectively, preferably 0.08 μm or less and 0.1 μm or less, more preferably 0.05 μm or less and 0.1 μm or less, and further preferably 0.05 μm or less and 0.07 μm or less.

Setting the surface roughness of the hard film within the above-described range makes it possible to form a smooth worked surface that is not roughened.

The value of Ra (arithmetic average roughness) is an average value showing a roughness state of a section that is extracted from a roughness curve by a reference length. One step of the roughness curve does not greatly affect a measured value, whereby Ra (arithmetic average roughness) can most accurately represent conditions of surface roughness in a wide area.

However, if an incremental forming tool has large protrusions, even though having a sufficiently small Ra (arithmetic average roughness), the protrusions scratch off a surface of a mating material to generate linear marks and the like, resulting in deterioration in surface quality. Moreover, abrasive particles that are generated at this time may clog recesses, which causes metals to be brought into contact with each other to occur adhesion, whereby surface quality may be greatly deteriorated. Thus, the recesses that are generated by scratching of the protrusions may remain as damage on the surface of a formed object, and a satisfactory appearance may not be obtained.

In particular, the incremental forming tool, which has the hard film on the surface, has a high wear resistance, and the large protrusions hardly wear. Thus, the incremental forming tool can make scratches on a worked surface over a long period of time.

In the present invention, in addition to setting Ra (arithmetic average roughness) of the surface of the hard film to 0.2 μm or less, Rpk (average reduced peak height), which represents an average height of reduced peaks above a core part of a material ratio curve of a roughness curve, is set to 0.15 μm or less. This prevents the incremental forming tool from deeply scratching a surface of a metal plate. In this manner, a formed object having a smooth surface can be obtained although processing conditions are not set so as to melt the surface of the metal plate.

Figure 3:
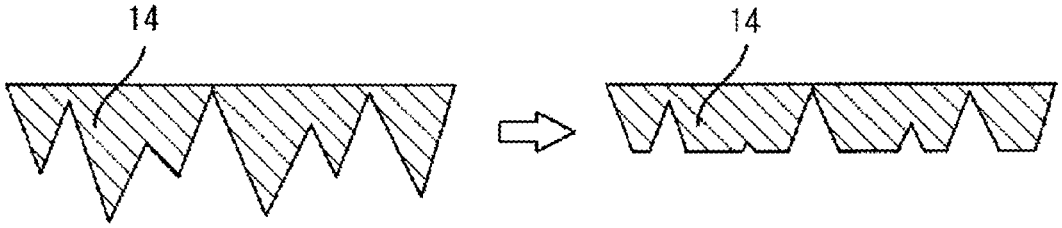
FIG. 3 is a schematic diagram illustrating states of a surface of a hard film before polishing (on the left in the drawing) and after polishing (on the right in the drawing).

The incremental forming tool in which the surface of the hard film has an Rpk (average reduced peak height) of 0.15 μm or less, can be manufactured by selectively grinding largely protruding peaks on the surface of the hard film so as to uniform the height of the peaks, as illustrated in FIG. 3.

Figure 4:
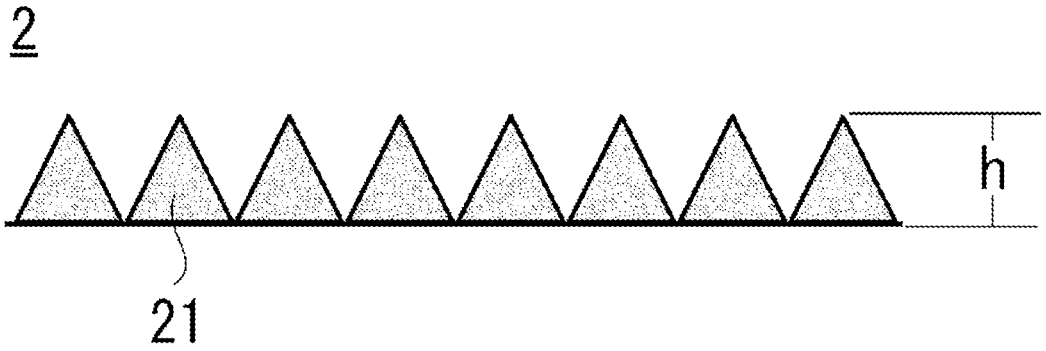
FIG. 4 is a schematic diagram of a polishing sheet of fixed abrasive grains having a uniform height.

The largely protruding peaks can be selectively ground by using a polishing sheet of fixed abrasive grains that have a constant size and a uniform height and that are regularly arranged, as illustrated in FIG. 4.

Figure 5:
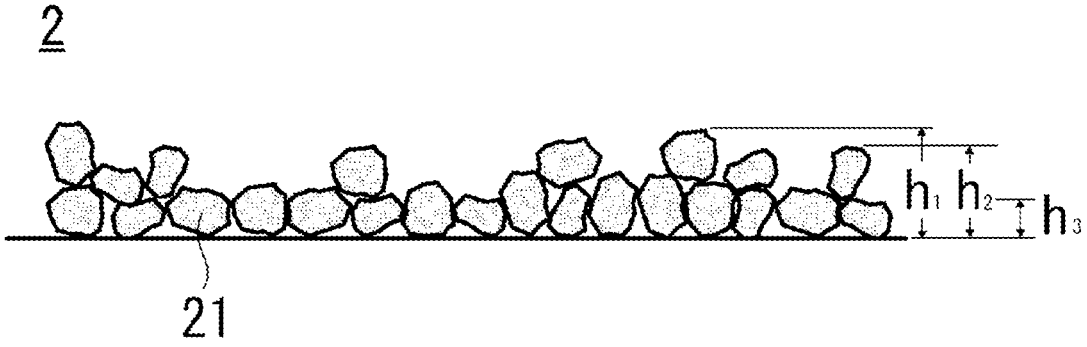
FIG. 5 is a schematic diagram of a polishing sheet of abrasive grains having non-uniform heights.

On the other hand, in a case of a polishing sheet of abrasive grains having non-uniform heights, as illustrated in FIG. 5, parts at which the abrasive grains cohere together can greatly scrape the surface of the incremental forming tool to generate deep dales (recesses), whereby relatively protruding peaks are formed. Thus, Rpk (average reduced peak height) is difficult to decrease.

In addition, in a case of an abrasive agent of free abrasive grains, the sizes of the abrasive grains may be uniform, but the abrasive grains may cohere together to produce large abrasive grain lumps. These abrasive grains are difficult to uniformly disperse, and uneven distribution of the abrasive grains cannot be completely eliminated. For these reasons, it is difficult to uniform the heights of peaks on the surface of the incremental forming tool.

Figure 6:
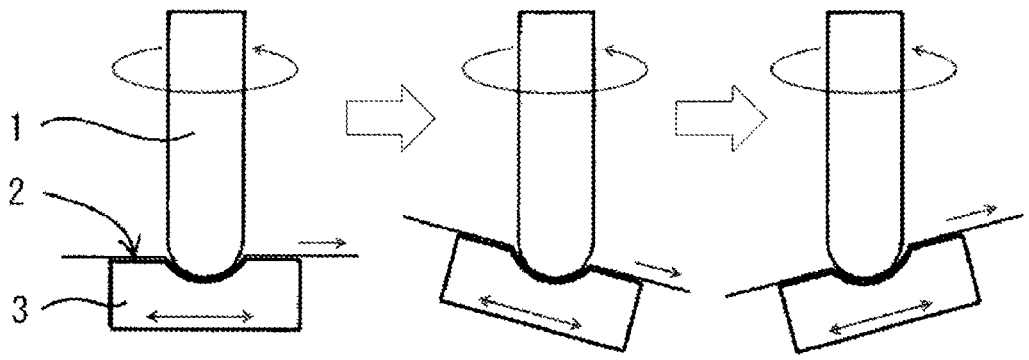
FIG. 6 illustrates a state of polishing the incremental forming tool.

In the present invention, a polishing sheet of fixed abrasive grains that have a constant size and a uniform height and that are regularly arranged, is held between a jig and the incremental forming tool, as illustrated in FIG. 6. The jig has a curvature slightly smaller (has a radius slightly larger) than that of the free curved surface of the incremental forming tool. Under these conditions, as shown by the arrows in FIG. 6, while the incremental forming tool is rotated, and the jig is swung, the polishing sheet is moved in one direction, whereby protruding peaks are selectively ground to have a uniform height.

Note that smaller Rpk (average reduced peak height) and smaller Ra (arithmetic average roughness) of the surface of the hard film are more preferable, but from the point of view of productivity such as polishing time, a practical lower limit of Rpk (average reduced peak height) is approximately 0.001 μm, whereas a practical lower limit of Ra (arithmetic average roughness) is approximately 0.001 μm.

The hard film that contains crystalline carbon can use a diamond film.

A diamond film is formed of synthetic diamond that is manufactured by chemical vapor deposition (CVD) using a hydrocarbon gas mixture. A diamond film can be manufactured by a hot-filament CVD method or a microwave plasma CVD method.

The hard film that contains crystalline carbon can be easily formed on the free curved surface of the hard metal base material by using a CVD method. In addition, a diamond film has a low friction coefficient and a high hardness and can be increased in thickness. Thus, it is possible to smooth the hard film without being affected by projections and recesses on the surface of the hard metal base material, by sufficiently increasing the thickness of the hard film, compared with the projections and recesses of the hard metal base material.

The hard film, which is a diamond film formed by the CVD method, contains carbon (C) of 99 mass % or greater. Even though the hard film is formed of diamond, if binder of a metal such as cobalt (Co), binder of hard ceramics, or another binder, exists at interfaces between diamond grains, as in a diamond sintered body (PCD), the binder that contains a metal component has a high affinity with a metal plate, whereby cohesion occurs, and a worked surface is roughened.

In the state in which the amount of carbon (C) in the hard film is in the above-described range, the affinity for the metal plate is reduced, resulting in prevention of adhesion.

The diamond film is preferably polycrystal. Polycrystalline diamond has characteristics that do not vary by a crystalline plane and a crystal orientation, and it has isotropic characteristics, unlike single crystal diamond. Thus, polycrystalline diamond shows uniform characteristics in all orientations, and it is hard and is hardly cleaved, with respect to a force from each direction, while having a high load-bearing capacity.

The film thickness of the hard film is preferably 5 μm or greater and 30 μm or less, and it is more preferably 10 μm or greater and 20 μm or less.

Figure 7:
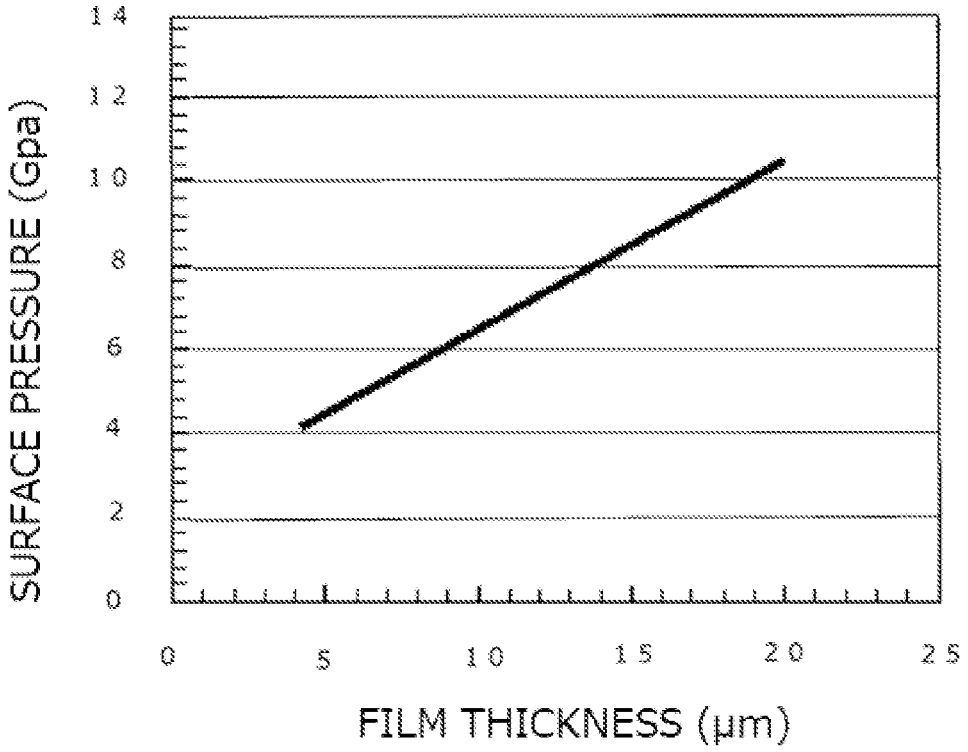
FIG. 7 is a graph illustrating a relationship between thickness of a hard film and surface pressure resistance.

In a case in which the film thickness of the hard film is too thin, cleavage easily occurs, and load-bearing capacity is reduced, whereby it is difficult to form a metal plate by sufficiently pressing it. On the other hand, in a case in which the film thickness of the hard film is too thick, residual stress of the hard film that is generated in depositing the hard film, increases, which may make the hard film be easily cleaved in incremental forming. A relationship between the film thickness of the hard film and surface pressure for pressing a metal plate is illustrated in FIG. 7.

(Hard Metal Base Material)

The hard metal base material can use any material that has a high hardness and that allows forming a diamond film thereon. An example of the hard metal base material includes a cemented carbide alloy made of a mixture of tungsten carbide (WC) and cobalt (Co).

The value of Rpk (average reduced peak height) of the free curved surface part of the hard metal base material is preferably 0.04 μm or greater, more preferably 0.05 μm or greater, further preferably 0.08 μm or greater, and yet further preferably 0.1 μm or greater and 0.25 μm or less.

In addition, Ra (arithmetic average roughness) is preferably 0.15 μm or greater and 0.4 μm or less.

In a case in which the surface roughness of the free curved surface part is too small, an anchor effect is not obtained, and the hard film is decreased in adhesiveness and tends to come off. On the other hand, in a case in which the surface roughness of the free curved surface part is too high, the hard film is not smooth, whereby the polishing time is increased, and actual (local) surface pressure is increased at remaining protrusions, resulting in a decrease in load-bearing capacity.

The hard metal base material can be manufactured as follows: a free curved surface having a desired shape is formed by polishing, and then, the surface thereof is roughened by an acid treatment or the like.

A metal plate that can be formed by the incremental forming tool of the present invention is not specifically limited on the condition that it can be plastically deformed. Examples of the metal plate include metal plate materials such as of galvanized steel, mild steel, high tensile strength steel, stainless steel, and aluminum alloy.

A relationship between the type of metal plate and surface pressure (GPa) required in incremental forming of the PAD metal plate is shown in Table 1.

TABLE 1

| | Ra (μm) | Thickness (mm) | Surface Pressure (Gpa) |
|---|---|---|---|
| Galvanized Steel Plate | 0.2 to 1.5 | 0.35 to 2.5 | 11.0 |
| Mild Steel | 0.2 to 1.5 | 0.35 to 2.5 | 11.0 |
| High Tensile Strength Steel Plate | 0.2 to 1.5 | 0.35 to 1.5 | 11.0 |
| Stainless Steel Plate | 0.05 to 0.2 | 0.35 to 2.5 | 12.0 |
| Aluminum Alloy Plate | 0.1 to 1.5 | 0.35 to 2.5 | 4.8 |

EXAMPLES

The present invention will be detailed with reference to examples hereinafter, but the present invention should not be limited to the examples described below.

Example 1

A hard metal base material (cemented carbide alloy) of a 20-mm diameter rod made of WC and containing 6% of Co was prepared. After the surface of the hard metal base material was polished, a free curved surface part having a desired shape was formed. Then, the free curved surface part was immersed in a 5% nitric acid solution for 10 minutes at room temperature, whereby cobalt in the hard metal base material was liquated, and the surface was roughened.

A hard film containing crystalline carbon (diamond film, which is a diamond film formed by a CVD method) having a thickness of 20 μm was formed on the roughened surface of the free curved surface part of the hard metal base material by a hot-filament CVD method.

The surface of the hard film was brought into contact with a polishing sheet (manufactured by 3M, Trizact diamond lapping film) of fixed abrasive grains that have a constant size and a uniform height and that are regularly arranged. Moreover, a jig that has a curvature slightly smaller than that of the free curved surface of the incremental forming tool was pressed against the polishing sheet to support it from a back side.

Under these conditions, while the hard metal base material was rotated, and the jig was swung, the polishing sheet was moved in one direction. Polishing was thus performed for 12 hours, whereby an incremental forming tool was produced.

Example 2 to Example 11

Incremental forming tools were produced in the same manner as in Example 1, except that roughening of the surface of the hard metal base material and polishing of the hard film were performed under the conditions shown in Table 2.

The surface roughness of the hard metal base material was measured after the surface of the hard metal base material was roughened, and the surface roughness of the hard film was measured after the hard film was polished. Then, the immersion time of the hard metal base material and the polishing time of the hard film were finely adjusted so as to achieve a desired roughness.

Comparative Example 1

An incremental forming tool was produced in the same manner as in Example 1, except that polishing was performed under the conditions shown in Table 2 by using a polishing sheet (manufactured by 3M, diamond lapping film) of abrasive grains that are dispersed and fixed on the sheet and that have non-uniform heights.

Comparative Example 2

An incremental forming tool was produced in the same manner as in Example 1, except that a diamond sintered body (PCD) was formed on the surface of the hard metal base material and that polishing was performed under the conditions shown in Table 2.

<Evaluation of Incremental Forming Tools>

The incremental forming tools of Examples 1 to 11 and Comparative Examples 1 and 2 were evaluated by the following methods.

The results of evaluation are shown in Table 2 together with the polishing conditions.

(Measurement of Surface Roughness)

The values of Rpk (average reduced peak height) and Ra (arithmetic average roughness) of the hard film were measured in conformity with JIS B 0671-2002 and specifications in JIS B 0601-2001, respectively, by using a stylus profilometer.

In addition, the hard film was peeled off, and Rpk (average reduced peak height) and Ra (arithmetic average roughness) of the surface of the hard metal base material were measured in the same manner as in the case of the hard film.

(Measurement of Film Thickness of Hard Film)

The film thickness of the hard film was measured under the following conditions by FT-IR interferometry.

A reflection spectrum of a sample was measured by using gold as a reference.

The number of interference fringes in a measured wave number range (2600 $cm^{-1}$ to 1600 $cm^{-1}$) was measured, and the thickness of the sample was calculated from the following formula.

$$\text{Thickness}=(n/v1-v2)/2\times10000 \quad \text{(Formula)}$$

n: number of interference fringes V1: 2600 $cm^{-1}$ V2: 1600 $cm^{-1}$

Name of apparatus: FTS7000e/Infrared microscope UMA600, manufactured by Agilent technologies Measurement method: Microscopic reflection method Resolution: 4 $cm^{-1}$ Incidence angle: 45 degrees on average (Load-Bearing Capacity)

Fracture strength (load-bearing capacity) was evaluated as follows: a load was continuously applied to the hard film via a carbide indenter (6-mm diameter ball), and an acoustic emission (AE) wave that occurred in response to generation of a crack due to elastic deformation of the hard film was detected as sound.

The load-bearing capacity (kN) and a maximum surface pressure (GPa) that can be applied within the range of the load-bearing capacity are also shown in Table 2.

TABLE 2

| | Hard Metal Base Material | | | Hard Film | | |
|---|---|---|---|---|---|---|
| | Immersed Time (minute) | Ra (μm) | Rpk (μm) | Ra (μm) | Rpk (μm) | Film Thickness (μm) |
| Example 1 | 10 | 0.272 | 0.194 | 0.023 | 0.010 | 20 |
| Example 2 | 15 | 0.393 | 0.157 | 0.003 | 0.003 | 20 |
| Example 3 | 10 | 0.272 | 0.194 | 0.003 | 0.003 | 20 |
| Example 4 | 5 | 0.130 | 0.102 | 0.004 | 0.003 | 20 |
| Example 5 | 10 | 0.364 | 0.201 | 0.182 | 0.116 | 20 |
| Example 6 | 10 | 0.287 | 0.202 | 0.139 | 0.097 | 20 |
| Example 7 | 10 | 0.360 | 0.197 | 0.007 | 0.005 | 20 |
| Example 8 | 30 | 0.372 | 0.352 | 0.028 | 0.007 | 20 |
| Example 9 | 10 | 0.196 | 0.189 | 0.048 | 0.036 | 20 |
| Example 10 | — | — | — | 0.099 | 0.064 | 20 |
| Example 11 | 15 | 0.252 | 0.165 | 0.005 | 0.005 | 5 |
| Comparative Example 1 | 40 | 0.329 | 0.434 | 0.168 | 0.381 | 20 |
| Comparative Example 2 | — | — | — | 0.215 | 0.24 | 500 |

| | | | Incremental Forming Tool | |
|---|---|---|---|---|
| | Polishing Sheet | Polishing Time (hr) | Load-Bearing Capacity (KN) | Maximum Surface Pressure (GPa) |
| Example 1 | A | 12 | 4.26 | 12.5 |
| Example 2 | A | 20 | 5.42 | 15.9 |
| Example 3 | A | 20 | 6.04 | 17.8 |
| Example 4 | A | 20 | 4.13 | 12.1 |
| Example 5 | A | 2 | 3.87 | 11.4 |
| Example 6 | A | 2.5 | 4.08 | 12.0 |
| Example 7 | A | 20 | 5.22 | 15.4 |
| Example 8 | A | 12 | 1.79 | 5.3 |
| Example 9 | A | 10 | 4.8 | 14.1 |
| Example 10 | A | 5 | — | — |
| Example 11 | A | 20 | — | — |
| Comparative Example 1 | B | 20 | — | — |
| Comparative Example 2 | A | 20 | — | — |

—: Not measured

A: Polishing sheet of abrasive grains that have a constant size and a uniform height and that are regularly arranged B: Polishing sheet of abrasive grains having non-uniform heights The incremental forming tools of Examples 1 to 4, 6, 7, and 9 showed high maximum surface pressures, and cracks were not generated in the hard film at the time a surface pressure necessary in incremental forming of a metal plate was applied. Thus, the results show that they can be employed in forming a wide variety of metal plates. On the other hand, Example 8 showed a low load-bearing capacity due to excessively roughening the surface of the hard metal base material.

In comparative Example 1, in which the polishing sheet of abrasive grains having non-uniform heights was used, the Rpk (average reduced peak height) of the hard film did not become 0.15 μm or less.

<Evaluation of Formed Objects (Metal Plates)>

Each of the incremental forming tools of Examples 1 to 11 and Comparative Examples 1 and 2 was attached to an industrial articulated robot, and incremental forming was performed under the conditions shown in Table 3, at an average sliding speed of the incremental forming tool of 0.1 m/s.

TABLE 3

| | Plate Thickness (mm) | Load (N) | Feeding Pitch in Z direction (mm) | Surface Pressure (MPa) |
|---|---|---|---|---|
| Galvanized Steel Plate | 0.7 | 5000 | 0.9 | 250 |
| Mild Steel | 0.7 | 5000 | 0.9 | 250 |
| High Tensile Strength Steel Plate | 0.7 | 1125 | 0.3 | 1125 |
| Stainless Steel Plate | 0.8 | 4000 | 0.3 | 400 |
| Aluminum Alloy Plate | 1.1 | 4000 | 0.3 | 400 |

Z direction: Thickness direction of metal plate

The value of Ra (arithmetic average roughness) and the appearance of the formed object was evaluated as described below.

The results of evaluating the galvanized steel plate are shown in Table 4.

(Surface Roughness)

The value of Ra (arithmetic average roughness) of the formed object (metal plate) was calculated by averaging values of freely-selected five points that were measured in conformity with specifications in JIS B 0601-2001, by using a stylus profilometer.

<Evaluation of Appearance>

Excellent: The worked surface was not roughened.

Average: The worked surface was partially roughened.

Poor: The entirety of the worked surface was roughened.

TABLE 4

| | Formed Object (Metal Plate) | |
|---|---|---|
| | Ra (μm) | Appearance Evaluation |
| Example 1 | 0.091 | Excellent |
| Example 2 | 0.067 | Excellent |
| Example 3 | 0.067 | Excellent |
| Example 4 | 0.068 | Excellent |
| Example 5 | — | Average |
| Example 6 | 0.541 | Excellent |
| Example 7 | 0.071 | Excellent |
| Example 8 | 0.099 | Excellent |
| Example 9 | 0.133 | Excellent |
| Example 10 | 0.293 | Excellent |
| Example 11 | 0.071 | Excellent |
| Comparative Example 1 | 0.841 | Poor |
| Comparative Example 2 | 1.735 | Poor |

—: Not measured

The results of evaluating the appearances of the metal plates of soft steel, high tensile strength steel, stainless steel, and aluminum alloy were similar to those of the metal plate of galvanized steel.

The results in Table 4 show that the incremental forming tool of the present invention, in which Rpk (average reduced peak height) is 0.15 μm or less, and Ra (arithmetic average roughness) is 0.2 μm or less, can form a formed object without roughening the surface thereof.

The comparison among Examples 5, 6, and Comparative Example 1 shows that occurrence of surface roughening is very susceptible to Rpk (average reduced peak height).

REFERENCE SIGNS LIST

1 Incremental forming tool
11 Holding part
12 Free curved surface part
13 Hard metal base material
14 Hard film
2 Polishing sheet
21 Abrasive grain
3 Jig
100 Incremental forming apparatus
101 Fixed pressing tool
102 Movable pressing tool
103 Support frame
104 Metal plate
h Height of abrasive grain

The invention claimed is:

1. An incremental forming tool comprising:

a holding part being configured to be attached to an incremental forming apparatus; and a free curved surface part being configured to press a metal plate, the free curved surface part being made of at least a hard metal base material and having a hard film that contains crystalline carbon, on a surface of the free curved surface part, a surface of the hard film having an Rpk of 0.15 μm or less, which is calculated from a material ratio curve of a roughness curve specified in JIS B 0671, and also having an Ra of 0.2 μm or less, which is calculated from a roughness curve specified in JIS B 0601.

2. The incremental forming tool according to claim 1, wherein the Rpk of the surface of the hard film, which is calculated from the material ratio curve of the roughness curve specified in JIS B 0671, is 0.08 μm or less, and the Ra of the surface of the hard film, which is calculated from the roughness curve specified in JIS B 0601, is 0.1 μm or less.

3. The incremental forming tool according to claim 1, wherein a surface of the hard metal base material of the free curved surface part has an Rpk of 0.04 μm or greater, which is calculated from a material ratio curve of a roughness curve specified in JIS B 0671.

4. The incremental forming tool according to claim 1, wherein a surface of the hard metal base material of the free curved surface part has an Rpk of 0.1 μm or greater and 0.25 μm or less, which is calculated from a material ratio curve of a roughness curve specified in JIS B 0671.

5. The incremental forming tool according to claim 1, wherein a surface of the hard metal base material of the free curved surface part has an Ra of 0.15 μm or greater and 0.4 μm or less, which is calculated from a roughness curve specified in JIS B 0601.

6. The incremental forming tool according to claim 1, wherein the hard film has a film thickness of 5 μm or greater and 30 μm or less.

7. The incremental forming tool according to claim 1, wherein the hard film is made of diamond that is formed by a CVD method.

* * * * *